United States Patent [19]

Muldery et al.

[11] 4,191,521

[45] Mar. 4, 1980

[54] BATTERY MOULDING OF PANELS

[76] Inventors: Hendrikus Muldery, 25, Lennox St., Union Extension No. 1, Germiston, Transvaal, South Africa, 1401; Heinz Schubert, 11, Becker St., South Crest, Alberton, Transvaal, South Africa, 1450

[21] Appl. No.: 895,805

[22] Filed: Apr. 12, 1978

[30] Foreign Application Priority Data

Apr. 22, 1977 [ZA] South Africa ..... 77/2448

[51] Int. Cl.[2] ..... B28B 7/26

[52] U.S. Cl. ..... 425/432; 249/81; 249/101; 249/120; 249/129; 249/172

[58] Field of Search ..... 425/441; 249/119, 120, 249/129, 81, 101, 172

[56] References Cited

U.S. PATENT DOCUMENTS

| | | | |
|---|---|---|---|
| 1,760,282 | 5/1930 | Pedersen | 249/129 |
| 3,628,766 | 12/1971 | Hartmann | 249/129 |
| 3,744,184 | 7/1973 | Niemi et al. | 249/129 |
| 3,954,377 | 5/1976 | Scholz et al. | 249/112 |
| 4,067,941 | 1/1978 | Gaudelli et al. | 249/129 |

FOREIGN PATENT DOCUMENTS

| | | | |
|---|---|---|---|
| 1013765 | 12/1965 | United Kingdom | 249/129 |
| 185250 | 7/1966 | U.S.S.R. | 249/129 |

*Primary Examiner*—John McQuade

*Attorney, Agent, or Firm*—Cushman, Darby & Cushman

[57] ABSTRACT

A method of moulding a panel, in particular a prefabricated wall panel, apparatus for carrying out such method and the products thereof wherein the panels are moulded in a substantially upright orientation in moulds split along the plane of the panel thereby enabling a large number of pancls to be moulded in juxtaposed relationship, and, where required, a relief pattern to be formed in each major face thereof and also, if required, a tongue to be formed along one longitudinal edge of the panel and a groove along the other.

12 Claims, 6 Drawing Figures

BATTERY MOULDING OF PANELS

THIS INVENTION relates to the moulding of panels or other usually flat articles from a flowable mix of settable material such as cementitious mixes for example.

The invention is particularly concerned with the moulding of concrete panels suitable for use in the construction of the well known precast walls. In the case of such panels it is, without the use of actual bricks, not possible to provide both faces of the panels with an aesthetically pleasing relief pattern. The results in one side of such a precast wall being of inferior appearance to the other side which has such a relief image moulded therein.

The reason for this is that the panels are always moulded in flat moulds having the reverse relief pattern on the bottom thereof. This use of flat moulds requires a large amount of labour to produce panels at a satisfactory rate and such labour is costly which in turn reflects on the price of the precast walls.

It is the object of this invention to provide a mould apparatus for moulding panels or like flat objects wherein a relief pattern can be obtained on both faces of the panel and also labour may be substantially reduced.

The moulding of a panel or other generally flat article using a mould assembly of this invention involves locating on edge a mould split in a plane generally parallel to the plane of the mould cavity, casting into said mould cavity a settable material, allowing the material to set sufficiently to enable it to be removed from the mould and thereafter opening the mould and removing the cast article.

This method can provide for the mould to have major faces bearing a relief pattern for application to the article; for the mould surfaces to be of a polymeric material; for the cast article to be of either a cementitious material or a clay or other material which is rendered rigid by firing in which case the cast article is fired after removal from the mould; for the article to be an elongated flat panel in which case it is preferably cast in an end-on orientation and for the mould to be vibrated if required during casting of the settable material.

The invention also provides a mould assembly comprising at least three mould members releasably cooperable with each other to define upwardly extending mould cavities between them wherein inlet apertures are provided at the upper ends of such mould cavities.

Further features of the invention provide for the mould members to be movably, optionally releasably supported on a frame therefor so as to enable the removal of cast articles therefrom to be carried out, and for the mould members to embody heating means for warming the mould thereby to speed up the curing process.

In the mould assembly it is preferred that there be a relatively large number of mould members so as to define say six or more mould cavities and preferably of the order of twenty to forty mould cavities. Conveniently a mould member at one end of the assembly is fixed in a substantially vertically extending orientation and the other mould members are pivotally secured to the frame at or adjacent their lower ends so that they can be pivotted away from each other progressively to open the mould cavities.

The preferred application of the invention is to the casting of concrete or clay panels suitable for the construction of prefabricated walls. Such panels are generally located in vertical planes one on top of the other with the longitudinal edges interengaging and the ends of each panel located by a groove in an upright post anchored to the ground. In order to save factory space the panels are preferably moulded with their length extending upwardly. This orientation of casting of the panels also enables tongue and groove type of formations to be formed along the longitudinal edges of the panels so that positively no gap is provided between adjacent panels in use: in the case of prior art panels such a gap has become fairly commonplace. It will be easily understood that use of a mould as defined above enables a relief pattern of the desired design to be moulded into both major faces of the panel or a smooth finished surface to be formed, as may be required.

In order that the advantages and features of the invention may be more fully understood the application of the invention to the manufacture of panels suitable for erection of precast walls will now be exemplified. In the following description reference will be made to the accompanying drawings in which.

Figure 1:
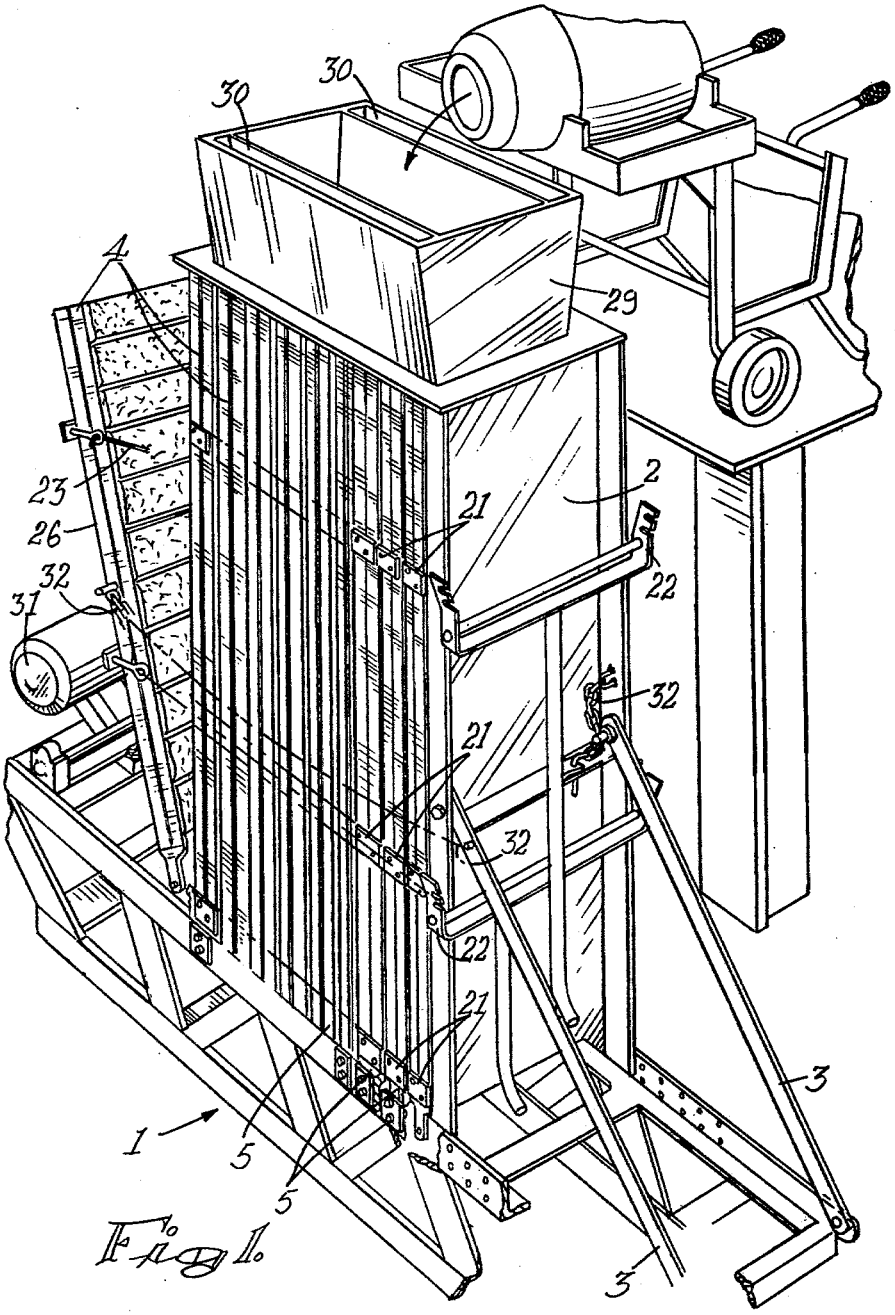
FIG. 1 is an isometric view of a mould assembly according to the invention.

In this embodiment of the invention a supporting frame 1 has one vertical mould member 2 fixed relative thereto by means of any suitable means which conveniently includes stays 3 extending in a direction opposite the other mould members 4 which are pivotally supported on the frame at or below their lower ends 5.

The pivotally mounted mould members can be rotated about their pivots between positions in which they are parallel to the fixed mould member and positions in which they are inclined away from the fixed mould member. In the former positions the mould members each define mould cavities with adjacent mould members in the manner which is hereinafter described, each of such mould cavities being open at their upper ends but sealed around the remainder of their peripheries.

Figure 2:
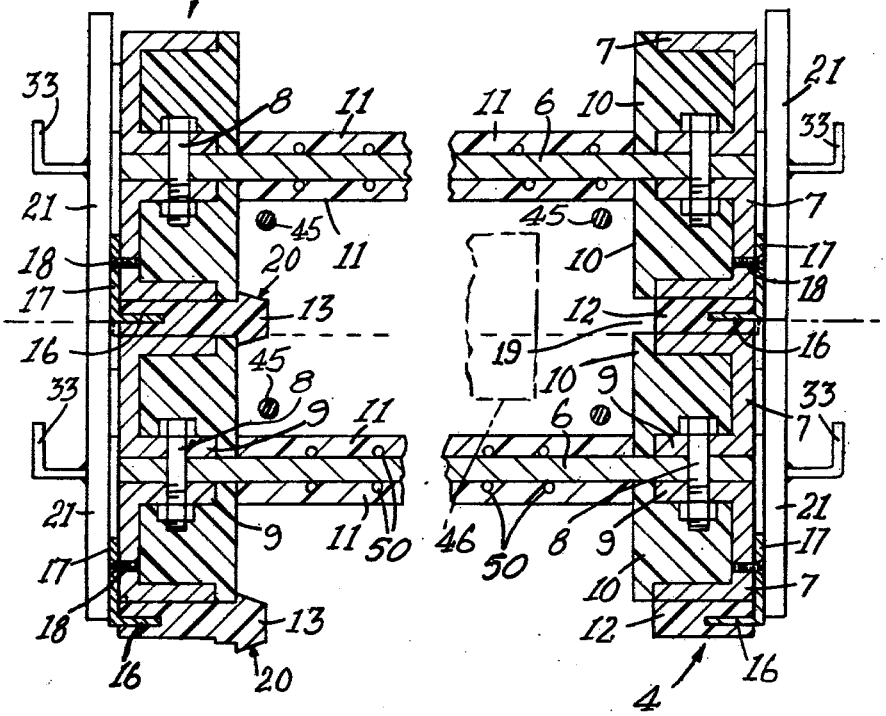
FIG. 2 is a cross-section taken through two adjacent mould members in their closed position.

The construction of the mould members and the manner in which sealing thereof relative to adjacent mould members is achieved is clearly illustrated in FIG. 2. Each mould member comprises a rectangular plate 6 to each face of which is secured an inwardly directed channel shaped section 7. The channel sections extend along both vertical edges and the lowermost edge of each face of each plate and the plates form the supports for the major faces of the moulded panels. The channel members are conveniently attached to the plates by bolts 8 passing through the flanges 9 of the channel members on each face of the plate and through the plates themselves.

A suitable plastic, preferably elastomeric, liner 10 is moulded into the channels and preferably over the free edges of the flanges thereof to provide portions of peripheral side and bottom walls to the mould members.

Figure 3:
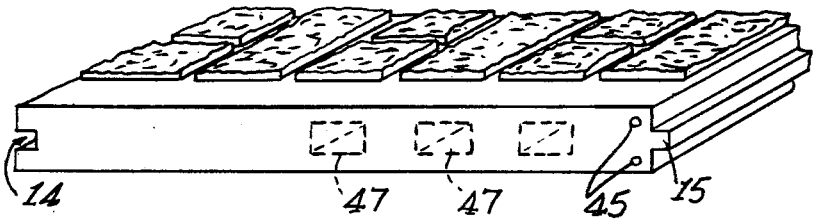
FIG. 3 illustrates in isometric view one end of a cast panel.

Conveniently the plastic material used for this purpose is polyurethane. Also a plastics, preferably polyurethane liner 11 is secured to each face of each plate and such liner may have an exposed surface bearing the reverse of any required relief pattern for the major faces of the cast panels. Such a relief pattern could be, for example, an imitation rock faced brick pattern as illustrated in FIG. 3. The liner 11 may carry heating means such as are illustrated at 50 in FIG. 2.

The transverse dimension of the channel members is chosen so that it is appreciably less that one half of the ultimate thickness of a moulded panel. This provides a space for a sealing strip 12, 13 between the outer surfaces of adjacent mould members. The sealing strips along opposite longitudinal edges of the mould members are different and are shaped to provide a central groove 14 along one edge and a tongue 15 along the opposite edge of the panel.

Both types of sealing strips are made of soft elastomeric material, and in each case they are moulded onto one flange 16 of a light weight length of angle iron. The latter extends out of the edge of the sealing strip remote from the cavity and the other flange 17 thereof is secured to an adjacent channel member by means of screws 18 for example.

In the case of sealing strips 12 of the one shape they are of simple rectangular cross-section and dimensioned such that their inner ends are recessed from the surfaces of the plastics material 10 defining the side surfaces of the mould cavity. This results in the mould cavity having a groove 19 along this edge which forms the tongue 15 on the moulded panel.

In the case of the sealing strips 13 of the other configuration, they have tapered head portions 20 which project into the edge of the mould cavity and thus form the grooves 14 in the opposite edges of the panels. The minimum thickness of the head portion is innermost and is slightly larger than the width of the tongue formed on the panels to ensure ease of fit of the tongues into the grooves.

In order to ensure that the mould members are located correctly in use spacer plates 21 are secured to the outside of the mould members at three positions which are spaced apart up the height of the mould members. These plates are dimensioned to abut each other once the sealing strips have been compressed to an effective extent and to maintain a constant depth to the mould cavities. Thus, the condition of the sealing strips will not affect the thickness of panels produced by the moulds.

Whilst the mould members have been described in great detail above it will be understood that numerous other configurations and designs are possible and the invention is in no way limited in its scope by the embodiment described which is preferred at the present time.

The remaining structural features and operation of the invention are most conveniently described in a description of the operation of the mould assembly which now follows.

In use the mould assembly which can comprise any suitable number of mould members (sixteen to thirty six being considered desirable) is closed and the mould members are held in the correct positions by urging them towards each other at locations in the central region up the height of the members and in an upper region.

This is conveniently effected using two vertically spaced lever assemblies 22 pivotally mounted to the fixed mould member 2, to draw steel cables 23 tightly across the edges of the mould members. In each case the steel cables extend from the lever assembly to a bar 24 pivotally mounted on a robust backing member 25 on the mould member 26 most remote from the fixed mould member. The steel cables are conveniently attached to the respective end of the bar in each by an eye bolt or the like. This construction ensures that even pressure is exerted on both sides of the assembly to cause all the spacer plates to abut properly.

Figure 4:
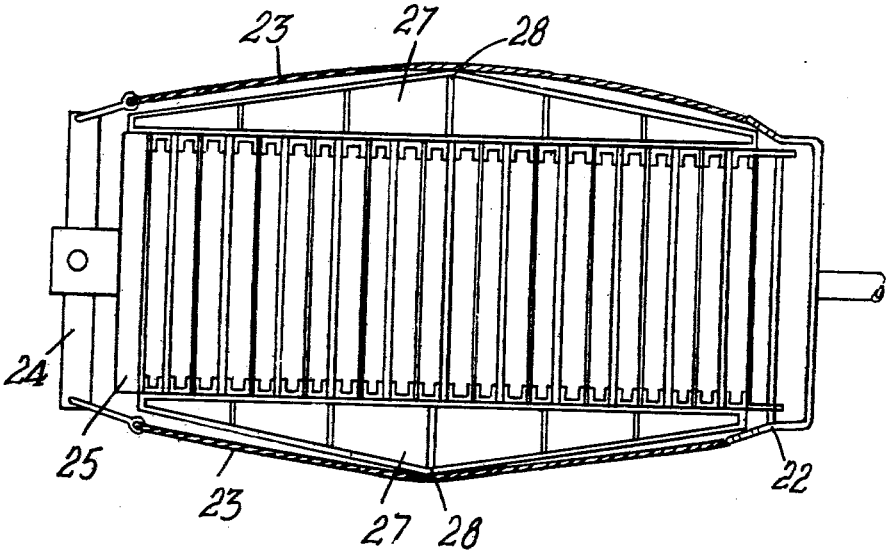
FIG. 4 illustrates in plan view the mould assembly in the closed position but with the hopper of FIG. 1 removed.

The lower ends of the mould members are all positively located in the transverse direction by the frame and in order to ensure proper transverse location of the upper regions the uppermost pair of cables 23 are passed over robust loose beams 27 which engage the outer edges of the mould members on each side thereof (see FIG. 4).

These beams are shaped such that they provide an apex 28 in a central region of their length and it is this region alone which is engaged by the cables.

With the mould members tightly clamped together as described any required reinforcing rods 45 are located in the mould cavities from the open upper ends thereof. Also, formers shown in dotted lines 46 may be located in the moulds to form cavities 47 in the completed article. These cavities will generally extend parallel to the plane of the panel. Thereafter a hopper 29 is located over the upper ends of the moulds the hopper being dimensioned to provide access to all mould cavities simultaneously. The hopper also provides a pair of air outlet passages 30 along each side thereof to ease the outflow of air from the cavities.

Concrete is then poured into the hopper and a vibrator 31, removably attached to the frame, is activated to ensure proper compaction thereof. Once the cavities have been filled the hopper can be removed and the upper ends of the cast panels can be smoothed off automatically but conveniently manually. The mould assembly may then be moved away to allow sufficient time for the concrete to cure adequately to enable the panels to be removed.

For the above purpose the frames may be provided with wheels for enabling them to be moved about easily or they may be mounted on trolleys from which they can be removed when required. Alternatively, the mould assemblies may be left in situ if this should be convenient.

It is to be noted that the cast concrete cannot easily dry out since water can only evaporate from the upper ends of the panels. Thus being so, electrical or other heating means can be embodied in the mould members to warm them and thereby accelerate the curing process. It has been found to be convenient to embed electrical heating elements in the liners attached to the metal plates.

In order to remove the panels the cables are slackened and unhooked from the lever assemblies. To prevent the mould members falling to an inclined position chains 32 are secured to the fixed mould member 2 and may be engaged with hooks 33 provided on the sides of the mould members. Thus the mould members may be released one at a time by selectively attaching the chain to mould members starting from a position most remote from the fixed mould member. The panels are removed one by one in this manner and only one labourer is required for this purpose.

As the panels are removed the sealing strips which form the grooves therein simply peel out as a result of their soft and resilient nature and their tapered shape.

It has been found that panels of a smaller thickness than is usual can be effectively made using the above described mould assembly. This is probably due to the added strength of the concrete caused by water substantially unable to evaporate from the concrete as a result of the small exposed upper end surface thereof in the moulds.

It will be understood that very little labour is required to utilize the above described mould assemblies and thus a substantial saving in labour costs will be achieved.

The invention is in no way limited to the above described embodiment of the invention which is purely illustrative thereof. The panels could be moulded with their lengths horizontal and the heights vertical and even single mould could be used for low volume production of certain types of panels. Also, the mould members may be releasable from the supporting frame if required and in such a case there is no limit to the number of panels which can be made to co-operate. In fact, the support frame could comprise a conveyor to render a manufacturing process continuous. Alternatively the mould members may be slidable longitudinally on frame members for supporting same or they may simply releasably attach to the next adjacent frame member whilst being suitably supported on a support surface.

Figure 6:
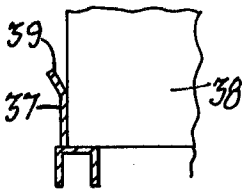
Figure 5:
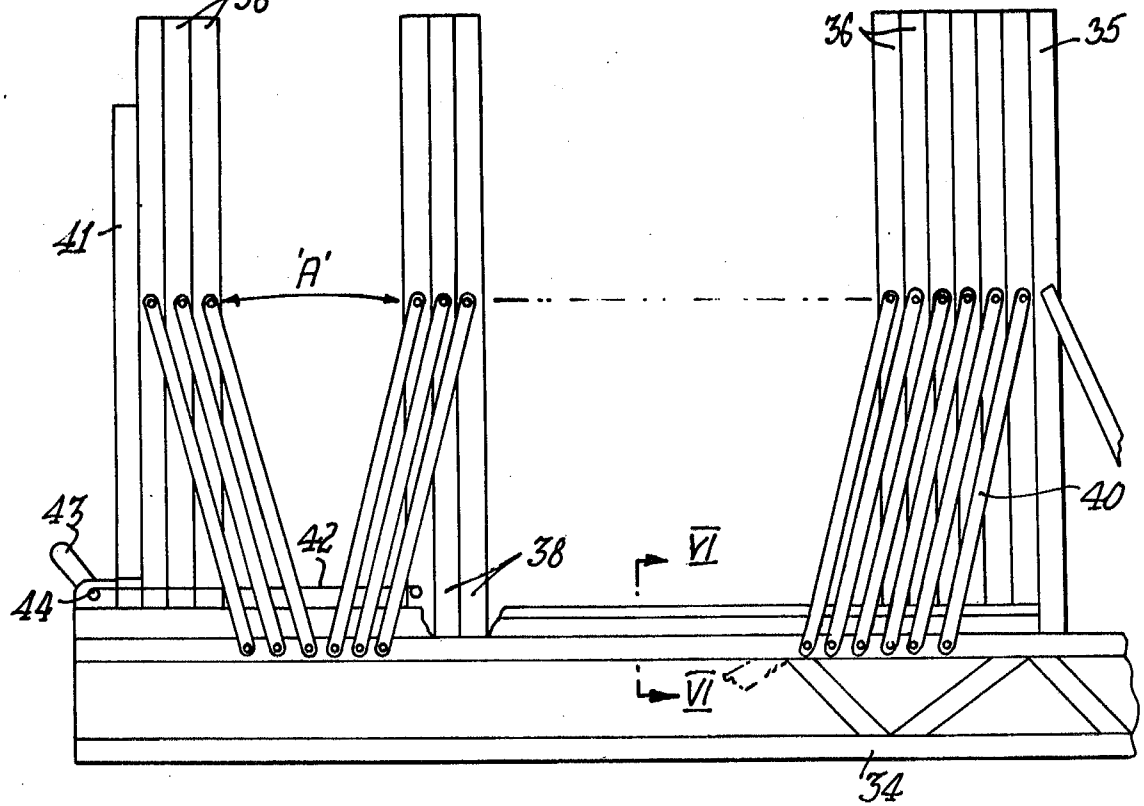
FIG. 5 is a side elevation of one alternative arrangement of a mould assembly; and, FIG. 6 is a cross-sectional view taken through one of the supporting frame members thereof as shown by line VI to VI in FIG. 5.

A further, and preferred alternative arrangement for the mould members is illustrated in FIGS. 5 and 6 of the accompanying drawings. In this instance the mould assembly has the same supporting frame 34 as is described above having towards one end thereof a fixed and vertically extending mould member 35 defining the end of a plurality of movable mould members 36. In this case the movable mould members are not secured to the frame at their lower ends, but are movably supported on the frame between guide plates 37 which are spaced apart to receive between them the lower ends 38 of the movable mould members. The guide plates preferably have their upper regions 39 bent slightly outwardly so that as a mould member is moved between the guide plates it is guided into its correct lateral position relative to the frame.

In the positions which the mould members assume when the cavities are closed each one has a link arm 40 attached centrally up the height thereof to each side of the mould member. The link arms extend downwardly to the frame and have their lower ends pivotally attached to the frame at a position spaced apart from their lower ends in a direction away from the fixed mould member 35. Thus, the link arms all extend downwardly in parallel relationship to each other at a small angle to the vertical when the mould members are in a position in which the cavities are closed.

As shown towards the lefthand side of FIG. 5 the mould members can be swung about their link arms into a position in which they are spaced from their adjacent mould members as indicated by arrow A. In this position a moulded article formed by the cavity defined between two adjacent mould members when they are in operative locations relative to each other can be removed since adequate space is provided between the two adjacent mould members when the one has been sung over on its link arms such that the latter are inclined in an opposite direction relative to the vertical. A stop member 41 can be provided against which the mould members can rest in the open position and as will be understood from the aforegoing description the mould cavities will be opened one by one and the moulded articles removed therefrom.

It will be understood that the arcuate movement through which each mould member will move initially tends to move somewhat upwardly as well as horizontally. Thus, if the mould member is maintained in parallel relationship to its adjacent mould member when an article is to be removed from between the two a shear force will be applied to the moulded article. In order to avoid this the mould member to be moved is peeled away from the moulded article and/or the adjacent mould member by firstly moving its lower end outwardly and away from the adjacent mould member. This is achieved with the aid of a cable 42 which can be releasably hooked onto the lower end of each mould member in turn and which can be pulled to move the mould member away from its adjcent mould member by means of a crank 43 and shaft 44 onto which the cable will be wound. Once the mould member has been peeled away from the other mould member it can be swung across on the link arms to a position in which the latter extend in an opposite direction relative to the vertical.

The latter described arrangement of the mould members embodying the link arms described is preferred where a large number of mould members is to be used to enable a large number of articles to be cast simultaneously. It has been found that the first described embodiment of the invention operates effectively with up to about twelve mould members whereas the last described arrangement operates with any number of mould members, for example, twenty-four to thirty-six or more. It will be understood that in the latter described embodiment of the invention the stop member 41 could be replaced by a second fixed mould member thereby rendering it unnecessary to move all the mould members back to their initial position prior to casting a second batch of articles. In such a case the moulds can be cleaned and prepared for re-use immediately after an article has been removed therefrom and this would render subsequent movement of all the mould members unnecessary.

In the last described embodiment of the invention the clamping of the mould members together and the spacing thereof could be achieved in exactly the same way as is described above with reference to FIGS. 1, 2 and 4.

What we claim as new and desire to secure by Letters Patent is:-

1. A mould assembly comprising at least three mould members, each bounded by a peripheral edge including a top, a bottom and side edges, and each releasably co-operable with each other to define upwardly extending mould cavities between them and inlet apertures at the upper ends of such mould cavities, a supporting frame for the mould members and linkage means pivotally interconnecting each mould member and said frame, said linkage means permitting the entire peripheral edge of a mould member to be moved away from a moulded article and a co-operating mould member to open the mould cavity defined between co-operating mould members.

2. A mould assembly as claimed in claim 1 in which the lower ends of the mould members are located between guide plates on the frame and have their lower ends supported by the frame in movable manner.

3. A mould assembly as claimed in claim 1 in which one mould member, being an outermost mould member, is fixed relative to the frame.

4. A mould assembly as claimed in claim 1 in which the mould members define cavities adapted to form precast wall panels.

5. A mould assembly as claimed in claim 4 in which the mould cavities are orientated such that the length of the wall panel is moulded in the vertical orientation.

6. A mould assembly as claimed in claim 5 in which the cavities are shaped to form a tongue along one longitudinal edge of a wall panel and a complimentary groove along the other longitudinal edge.

7. A mould assembly as claimed in claim 1 in which each mould member comprises a rigid, generally metal structure having polymeric cavity defining material attached thereto.

8. A mould assembly as claimed in claim 1 in which the mould members have heating means embodied therein.

9. A mould assembly as claimed in claim 1 in which vibrating means are provided for vibrating the mould members.

10. A mould assembly comprising at least three mould members releasably co-operable with each other to define upwardly extending mould cavities between them and inlet apertures at the upper ends of such mould cavities, a supporting frame for the mould members and linkage means interconnecting the mould members and the frame, said linkage means permitting both top and bottom regions of a mould member to be moved away from a co-operating mould member to open the mould cavity defined therebetween, said linkage means comprising link arms which are inclined to the vertical, and pivotally attached to the mould members at positions along the heights of the mould members and pivotally attached to the supporting frame, the link arms being arranged to extend substantially parallel to each other when the mould members are located relative to each other to define only closed mould cavities therebetween.

11. A mould assembly as claimed in claim 10 in which means are provided for holding the mould members in an upwardly extending orientation when a mould cavity is opened with the mould members on each side in close juxtaposed relationship to each other.

12. A mould assembly as claimed in claim 11 in which fixed mould members are provided at each end of said frame for co-operation with an adjacent mould member.

* * * * *